United States Patent [19]

Lyman

[11] 3,985,588

[45] Oct. 12, 1976

[54] SPINNING MOLD METHOD FOR MAKING PERMANENT MAGNETS

[75] Inventor: Joseph Lyman, Kennebunk, Maine

[73] Assignee: Cambridge Thermionic Corporation, Cambridge, Mass.

[22] Filed: Feb. 3, 1975

[21] Appl. No.: 546,581

[52] U.S. Cl. ..... 148/103; 148/31.57; 148/105; 148/108; 335/302

[51] Int. Cl.[2] ..... H01F 1/02

[58] Field of Search ..... 148/108, 105, 103, 31.57; 264/DIG. 58; 335/302; 249/137

[56] References Cited

UNITED STATES PATENTS

| | | | |
|---|---|---|---|
| 2,188,091 | 1/1940 | Baermann | 335/302 |
| 2,959,832 | 11/1960 | Baermann | 264/DIG. 58 |
| 2,965,953 | 12/1960 | Baermann | 264/DIG. 58 |
| 2,984,871 | 5/1961 | Venerus | 265/DIG. 58 |
| 3,540,945 | 11/1970 | Strnat et al. | 148/31.57 |
| 3,726,664 | 4/1973 | Parker et al. | 148/105 |
| 3,849,213 | 11/1974 | Baermann | 148/108 |

*Primary Examiner*—Walter R. Satterfield
*Attorney, Agent, or Firm*—Allen V. Hazeltine

[57] ABSTRACT

A method is described for producing permanent magnets, in accordance with which magnetic material in finely divided or powdered form, comprising an alloy of a rare earth metal and cobalt, is first premagnetized by subjecting it to a high-intensity magnetic field to magnetize the individual particles thereof, the particles are then introduced into a hardenable resinous material and caused to be distributed substantially uniformly throughout at least a region of said resinous material. While said particles are being introduced into and distributed throughout said resinous material, they are subjected to a magnetic field to align them magnetically. The resinous material is then hardened to form a body thereof in which said particles are maintained in magnetic alignment to form an effective permanent magnet structure. In preferred forms of the invention, fibrous material and/or fiberglass cloth or mat may be embedded in the matrix to enhance its strength. In addition, an auxiliary magnetizing coil may be embedded in the matrix for modulating the effective magnetic field of the permanent magnet on a temporary basis. Practice of the method permits the production of superior permanent magnets which may be of relatively large size compared to those producible in accordance with the methods of the prior art and whose resistivity may be controlled to adapt them for various applications such as use in magnetic bearings.

9 Claims, 1 Drawing Figure

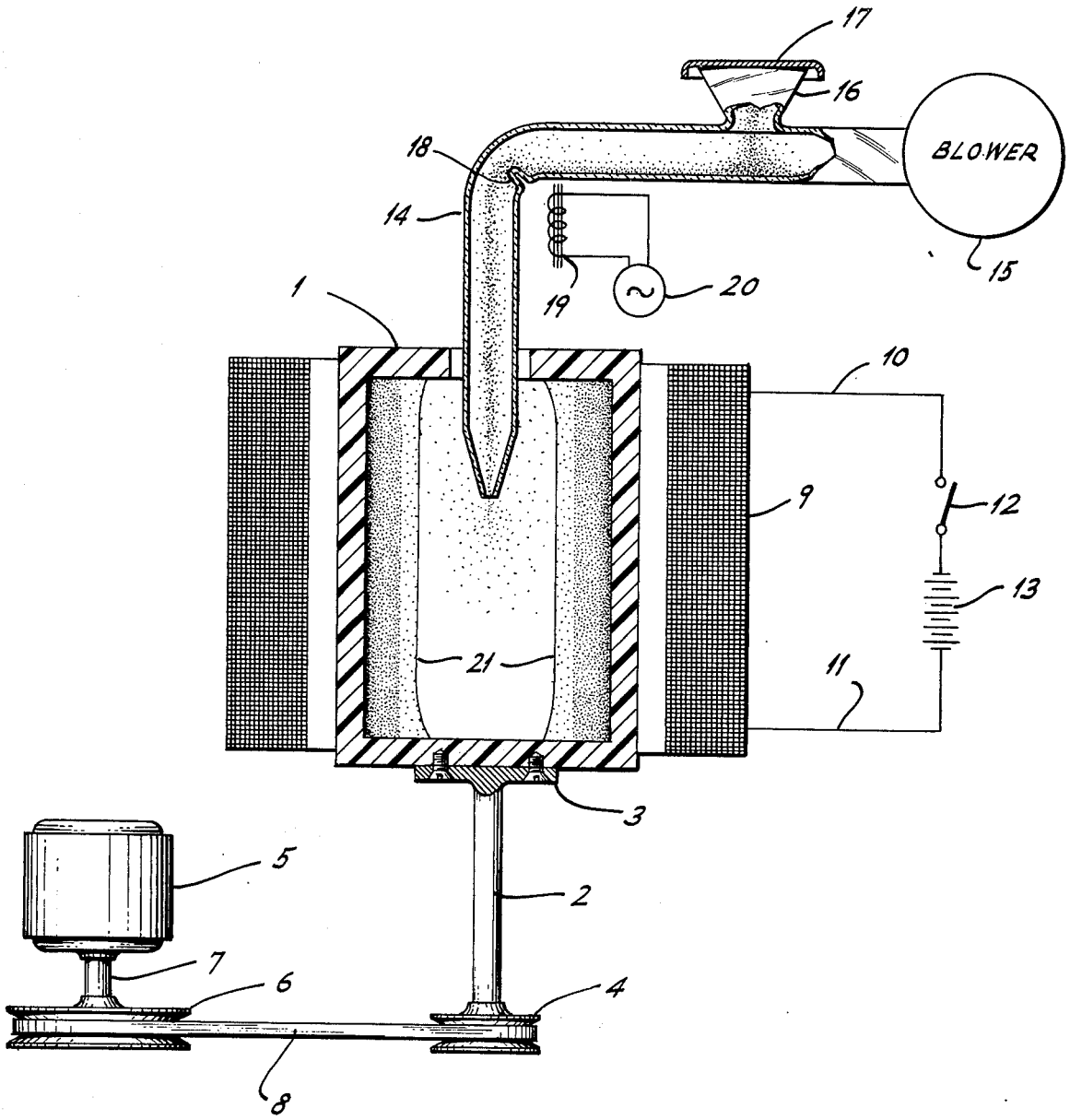
17
16
BLOWER
18
14
15
19
20
1
10
9
12
13
21
11
3
5
2
7
6
4
8

SPINNING MOLD METHOD FOR MAKING PERMANENT MAGNETS

This invention relates to an improved permanent magnet and method of manufacturing same using finely divided or powdered permanent magnet material consisting of alloys of rare earth metals, such as samarium, with cobalt. Permanent magnets made by the method are of particular utility when used in magnetic bearings such, for example, as that described in my prior U.S. Pat. No. 3,473,852.

It is known to manufacture permanent magnets by compacting finely divided magnetic material in a suitable mold by the application of pressure, then sintering the resultant magnet structure to bond the particles together into a unitary structure, and then exposing the structure to a magnetic field to magnetize it. A major problem which arises in the practice of this process is that the magnetic material at one stage of the process must be brought to a relatively high temperature, of the order of 1,100° C., and maintained at this temperature for several hours within plus or minus one degree. If the temperature is allowed to rise above a certain level, the magnetic quality of the material will be destroyed. On the other hand, if the temperature is allowed to fall below this level the magnet is not hard and is physically inferior. At temperatures between these two points, it is possible to have a part of the magnet harder than another part. In practicing this method,, the temperature is maintained in what is called a sintering oven, which usually comprises a glass tube 4 or 5 inches in diameter. The magnets which are being produced are stacked in what is called a boat in this tube. The tube is normally horizontally disposed, and an inert gas such as argon is pumped through the sintering oven during the cycle. This gas tends to cool certain parts of the magnet below others, and since the magnet rests on a metal framework comprising the boat, it is possible for the temperature at the point of contact to be quite different from the temperature at other parts of the magnet. The result is that when the final magnetization occurs, one part of the magnet will exhibit a greater strength than another. Using this process, it is almost impossible to produce a magnet with peripheral uniformity better than 1%, and it has been observed that in some instances the degree of non-uniformity may rise as high as 20%. Also the size of magnets which can be produced by this process is limited by two factors. First, the permissible size of the sintering oven restricts the total size of magnets which can be produced in it, a magnet five inches in diameter being about the largest which can be produced in the largest known sintering ovens. Secondly, the size of the magnets produced is limited by the fact that high-intensity magnetic fields are required to magnetize such a magnet after it is formed and such fields can be produced only in limited regions. In short, a magnet produced by the sintering process must be heated close to the temperature at which it is no longer a magnet and must be maintained there within very close temperature tolerance. Because of this very small tolerance, it is difficult to produce magnets having high peripheral uniformity since the method of holding the magnets in the sintering oven contributes to non-uniform temperature in the magnets themselves. Although it is possible to produce magnets of large circumference using the sintering process if the magnets are made in segments and then fastened together at a later stage, this segmentation also creates problems of uniformity which have not yet been solved.

It also is known to manufacture permanent magnets by mixing finely divided magnetic particles with a suitable binding material, such as a phenol formaldehyde resin, the mixture being placed in a suitable mold and pressure applied thereto and the binder permitted to harden to form the desired magnetic structure conforming to the mold. In this procedure, as described for example in U.S. Pat. No. 2,188,091, the magnetic structure is exposed to a magnetic field during an initial partial compacting step involving the application of moderate pressure, the structure is then further compacted by application of increased pressure, and the resultant structure is then finally magnetized by further exposure to a magnetic field. This process also is subject to substantial disadvantages because of the very high pressure applied in compacting the magnetic particles. Even though the magnetic particles are subjected to a high magnetic field (e.g., of the order of 3,000 Gauss) during compacting, nevertheless the high pressures applied during the compacting process tends to produce misalignment of the particles which cannot be corrected by subsequent exposure to a magnetic field. This same difficulty also is experienced in the sintering process previously referred to in which high pressures also are applied to compact the magnetic particles. Therefore, it has been common practice, after magnets have been formed by the sintering process, to grind away portions of the magnet in which the particles are misaligned, which results in considerable wastage.

The present invention is directed to a method which overcomes the aforementioned disadvantages of the prior art and which makes possible the production of permanent magnets of relatively large dimensions and high physical strength and which are readily machinable. Also, by the present method, it is possible to produce permanent magnets in which the magnetic particles are precisely magnetically aligned and uniformly distributed throughout the magnetic structure to provide a magnet of optimum effectiveness. In addition, by the present method, it is possible to produce permanent magnets having almost any desired resistivity, which is particularly desirable in the case of permanent magnets to be used in magnetic bearings where resistivity is a factor in controlling and minimizing drag in such bearings produced by the induction of eddy currents.

A particular feature of the present invention is that it does not require the use of extremely high temperatures such as those employed in the sintering process. If desired, the process may be carried out at room temperature, although in general it may be preferable to employ temperatures up to several hundred degrees to accelerate hardening of the binder material used in the process, but such temperatures are far lower than those used in the sintering process and are not such as to tend to produce demagnetization of the magnetized particles. Another important feature of the present process is that the particles of magnetic material are premagnetized before they are formed into the magnet structure. This is particularly advantageous since it admits of optimum magnetization of the particles, which in the case of many magnetic materials (e.g., samarium-cobalt) can only be achieved by subjecting them to very high magnetic fields — i.e., of the order of 60,000 to 100,000 Gauss. Such high magnetic fields can be produced only in a very restricted region — i.e., in a chamber of the order of 1½ inches in diameter and 2 inches long. When particles are premagnetized for use in accordance with the present invention, such premagnetization may be accomplished in small batches which can be accommodated in such a chamber until a sufficient quantity of them have been magnetized to be used in producing magnets. Once the particles have been magnetized, they may be stored indefinitely and used later as required.

In accordance with the present invention, magnetic material in finely divided or powdered form is first subjected to a relatively high magnetic field to magnetize the individual particles thereof, the particles are then introduced into a body of hardenable resinous material and are caused to become distributed substantially uniformly throughout at least a region of said body, and the resinous material is then hardened to form a matrix in which the particles of magnetic material are maintained in alignment to form an effective permanent magnet structure. While said particles are thus being introduced into and distributed throughout said resinous material, and during the hardening of the resinous material, they are simutaneously subjected to a magnetic field to align them magnetically. Because, in this process, the particles of magnetic material are premagnetized before forming them into the magnet structure it is possible to produce much larger magnets than was possible using the prior art methods.

In accordance with a preferred mode of practicing the invention there may be provided a partially closed container or mold of non-magnetic material and means for rotating said container. The container is first partially filled with a matrix-forming material which may be any suitable resinous material which will harden or polymerize under ambient or elevated temperatures and which will not be friable when hardened. For reasons which will be explained more fully hereinafter the matrix-forming material should be of relatively low viscosity. The container is rotated at a speed sufficient to cause the resinous material to be forced against peripheral surfaces of the container and there is then introduced into it powdered magnetic material, the particles of which have previously been magnetized by subjecting them to a magnetic field of relatively high intensity. By the rotation of the container and the resin contained therein, the magnetized particles are caused to be distributed throughout the resin and to become concentrated in the peripheral region of the resin by the action of centrifugal force produced by rotation of the container. While the powdered magnetic material is being introduced into the resinous material and distributed therethrough, it is subjected to a magnetic field to align the particles magnetically. This field may be of relatively lower intensity than that use to magnetize the particles initially. Then, while the container is still rotating and the aligning magnetic field is still being applied, the resinous material is permitted to harden, whereby the magnetic particles are caused to become bound in a matrix of the resinous material in desired orientations such as to produce a permanent magnet. Following this the non-magnetic material forming the container may be partially or completely removed from the magnetic structure formed therein. If desired a portion of the non-magnetic container may be left attached to the permanent magnet structure to provide a convenient means for mounting it in the apparatus in which it is to be employed.

The invention will be fully understood from consideration of the following detailed description thereof with reference to the single FIGURE of drawing illustrating a preferred form of apparatus for practicing the method of the invention.

Referring to the single FIGURE, there is provided a partially closed container 1 which may comprise a cylindrical side wall, a closed lower end portion and an upper end portion having a circular aperture therein permitting access to the inside of the container. The container may be formed of any suitable non-magnetic material such as hard plastic, polytetrafluoroethylene or aluminum, polytetrafluoroethylene being particularly desirable since it admits of ready removal of the container from the magnetic body to be formed therein after the process of making the magnet has been accomplished. A driving shaft is affixed to the lower end of container 1 by means of a flange 3 fastened thereto by machine screws or in any other suitable manner. Means are provided for rotating container 1 which may comprise a motor 5 having a driving pulley 6 mounted on its shaft 7 and connected by a belt 8 to a driven pulley 4 on the lower end of shaft 2. Encircling container 1 over substantially its entire length is a magnetizing coil 9 electrically connectable through leads 10 and 11 and a switch 12 to a battery 13. Since, in practicing the invention, coil 9 will be required to carry a relatively high current for a relatively long period of time, it is desirable to provide means for cooling the coil. This may be accomplished by forming the coil of a hollow conductor, suitably insulated, and providing means for circulating water or some other suitable cooling medium through it. Further there are provided suitable means for injecting finely divided particles of magnetic material into the space within container 1, which may comprise a bent tubular nozzle arrangement 14 formed of glass or suitable plastic material. This nozzle arrangement has its lower, constricted extremity inserted through the hole in the upper end of container 1 and has its opposite end connected to a blower or other suitable means 15 for providing a flow of air through it. The nozzle arrangement is provided with a hopper or other suitable access means 16 to permit supplying finely divided particles of magnetic material into the nozzle structure, and preferably at the inside of the bent portion thereof is provided a dam 18 for partially restricting the passage of the finely divided magnetic material into the lower constricted portion of the nozzle. Outside the nozzle structure, and in the immediate vicinity of this dam, is positioned an electromagnet 19 actuated by a source of alternating current 20 for agitating the magnetic particles and causing them to form a cloud which is entrained in the air flowing through the nozzle structure and into the space within container 1.

In practicing the invention using the apparatus according to the single FIGURE of drawing, there is first introduced into the container 1 through the aperture in its upper end, and preferably before the insertion therein of the nozzle structure 14, a quantity of a suitable resinous material for forming a matrix in which the finely divided particles of magnetic material will subsequently become embedded to form the desired permanent magnet structure. Preferably this is done while the container 1 is being rotated by being driven by motor 5 through shaft 2 affixed to the container since the resinous material will then be driven by centrifugal force against the cylindrical side surface of the container and caused to assume a cylindrical form as shown at 21. If desired, and depending on the characteristics of the material of which container 1 is made, its inner surface may first be coated with a suitable mold release material to facilitate later separation of the mold from the magnet formed therein. A suitable mold release is the silicone release compound sold under the trade name "Real Ease" by Barco Chemical, Inc. of Chicago, Illinois. However, if container 1 is made of a material such as polytetrafluoroethylene, no mold release is required, except where a cyanoacrylate is used, because such materials are readily separable from the formed magnet. Where cyanoacrylates are used, beeswax is a suitable mold release.

The matrix material may be any suitable resinous material which will harden or polymerize under ambient or elevated temperatures and which is not friable when hardened. Also this material should be of relatively low viscosity to permit achievement of a high density of magnetic particles in the magnet formed by the process, and also to facilitate ready alignment of the particles in the resinous material. Suitable materials include, for example, thermosetting plastic materials such as polyester, phenolic and epoxy resins and cyanoacrylates, the latter having been found to be particularly desirable because they harden under pressure without the aid of a catalyst and are of low viscosity, enabling the achievement of high magnetic particle density. Suitable cyanoacrylates are "Krazy Glue", sold by Krazy Glue, Inc. of Chicago, Illinois, and Eastman No. 910 sold by Eastman Kodak Co. Examples of suitable epoxy resins include Epon 1001, Epon 1004, Epon 1107 and Epon 1009, as described in U.S. Pat. No. 2,684,345. Another example of a suitable epoxy resin is Delta Bond 152 manufactured by Wakefield Engineering, Inc. and having the following characteristics:

Specific Gravity 2.46
Tensile strength psi at 77° F. 8,500
Compression strength psi at 77° F. 16,500

In addition, epoxidized novolic resins such as those described in U.S. Pat. Nos. 2,658,884; 2,658,885 and 2,716,099 can be used. Examples of suitable phenolic resins are phenol formaldehyde resins, including bakelite. Polyester resins including glyptal resins also may be employed, the latter resins being the reaction products of phthalic acid and glycerol. Clear Cast manufactured by American Handicrafts Co. of Fort Worth, Texas is a preferred polyester material. Typically such polyesters are formed by reacting an acid such as adipic, butyric, propionic or the like with alcohols such as pentaerythritol, propylene glycol and 1, 3 butylene glycol. A catalyst may be used to cause the resinous material to set up or harden rapidly at lower temperatures than otherwise would be possible.

After the resinous material has been introduced and has been caused to assume the cylindrical form shown in the drawing by rotating container 1 at a sufficiently high speed, finely divided particles of suitable permanent magnet material, which have been premagnetized, are introduced into the resinous material. Suitable means for accomplishing this are shown in the drawing and will be described hereinafter. First, however, it is in order to define the characteristics of the finely divided magnetic particles to be used in practicing the method of the invention. Preferably the magnetic material comprising the particles is an alloy comprising a rare earth metal, such as samarium, with cobalt in accordance with the general formula RCo. For example, highly satisfactory magnets have been produced in accordance with the invention using samarium cobalt having the formulation $SmCo_5$. Preferably the particles are of various sizes in the range from two to ten microns, which may be achieved using conventional grinding techniques which are well known in the art. Before introducing the particles into the resinous material, they are first exposed to a high intensity magnetic field — i.e. of the order of 100,000 Gauss or greater — to magnetize the individual particles.

In the arrangement of the drawing, the finely divided magnetized particles are introduced into the container 1 using the nozzle structure 14. A quantity of the particles are introduced into the nozzle structure through hopper 16. They are then subjected to the action of an alternating magnetic field in the vicinity of the dam 18, said field being produced by electromagnet 19 actuated by alternating current source 20 which may be a source of 60 cycle current. The magnetic field agitates the magnetized particles causing them to be dispersed into a cloud which is entrained in a current of air inside the nozzle structure produced by the blower 15 or other equivalent means. The particles then pass downward through the nozzle structure and through the orifice in its lower end into the container 1, and are caused to come in contact with the inner surface of the resinous material. By reason of the rotation of the container and the resinous material within it, they are caused to be distributed throughout the body of resinous material, and by centrifugal force are caused to move through said body of material toward its perimeter. By reason of the rotation of container 1 while the magnetized particles are being introduced, said particles ultimately will become substantially uniformly distributed around the circumference of the body of resinous material and throughout its length, and also will tend to concentrate themselves in a region of the body of resinous material in the vicinity of its peripheral surface while leaving a lower concentration of the particles in the region of the inner surface of said body. In fact, in regions immediately adjacent the inner surface of the body, the concentration of such particles may approach zero. To achieve the desired distribution and concentration of magnetic particles in the body of resinous material, it is desirable to rotate container 1 at relatively high speed — i.e. at a speed sufficient to produce forces on the magnetized particles which are in the range of from 375 to 3,000 G. In general, the higher the speed at which the container 1 is rotated, the more dense will be the concentration of the particles in the outer region of the body of resinous material, The denser the concentration of particles in the matrix of resinous material, the more effective will be the magnetic structure produced. I have found that, using speeds of rotation of container 1 sufficient to produce forces of the order of the 3,000 G, it is possible to achieve particle densities between 4 and 5 grams per centimeter, which yields highly satisfactory magnet structures comparable to those achieved by sintering methods and which are eminently satisfactory for use in magnetic bearing assemblies. To achieve the desired concentration of magnetized particles in the body of resinous material it is necessary to inject particles through nozzle 14 into container 1 for a sufficient period of time, and also to continue the rotation of container 1 after the particles have been so introduced for sufficient time. The amount of time required to achieve this result will of course depend on the characteristics of the magnet structure to be produced and also on the dimensions thereof, which can readily be determined in practice. By way of example, however, it was found that for a magnet structure having an external diameter of 20 cm., an internal diameter of 18.73 cm., and a length of 6 cm., a very satisfactory magnet was produced by introducing magnetized particles into the container 1 for a period of ten minutes and then continuing the rotation of the container at a speed of 2400 rpm. for a period of 60 minutes.

Prior to the introduction of the magnetized particles into the container 1 and the continued rotation of the container for a time sufficient to achieve the desired distribution of particles in the resinous matrix, the switch 12 is closed to connect battery 13 to the leads 10 and 11 of coil 9 to subject the magnetized particles to a magnetic field sufficient to properly align them in the matrix. For this purpose it has been found that a magnetic field of the order of 1000 Gauss or greater generally will suffice. Application of this magnetic field is continued throughout the period of time during which the magnetized particles are being introduced into the resinous material and are being distributed therethrough and until the resinous material has hardened. It is important that this be done; otherwise the particles may not become properly aligned because of the viscosity of the resinous material. After the rotation of container 1 has continued long enough to permit the particles to become properly aligned, such rotation is continued until the matrix of resinous material has hardened, either by the action of a catalyst included therein or by curing in the ambient temperature or by the application of heat from an external source. When hardening has been achieved, container 1 may be removed from the apparatus and either completely or partially separated from the magnet structure formed inside it. If desired, where the permanent magnet structure formed by the method herein described is relatively long compared to its diameter, it may be sawed or otherwise separated into a plurality of individual permanent magnets.

In an alternative mode of practicing the invention, particularly adapted for use where a cyanocrylate is used to form the matrix in which the magnetized particles are embedded, the premagnetized particles are first introduced into a mold which may be of aluminum treated with melted beeswax as a mold release. They are then agitated by exposing them to an ac magnetic field to cause them to be dispersed into a cloud, as hereinbefore described. The ac field is then removed and a dc field is applied, as hereinbefore described, to align the particles magnetically. Then cyanocrylate material is introduced into the mold, while the aligning field is still being applied, and finally the mixture of cyanocrylate and magnetized particles is subjected to pressure to harden the cyanocrylate. The latter may be accomplished by providing the mold with a suitable piston or plunger to which pressure is applied in a hydraulic press, the mold being so constructed as to be strong enough to withstand the pressure. Finally the permanent magnet formed is removed from the mold.

It is in order to point out that when the premagnetized particles of magnetic material are subjected to a magnetic field to align them, as above described, they tend to form themselves into chains with the particles lined up along the lines of force of the magnetic field, and it is particuarly important that the forces applied to the particles to concentrate them in the resinous matrix be applied perpendicular to these chains to avoid misalignment of the particles. The method of applying such forces hereinbefore described by the rotating the body of resinous material into which the particles are introduced is particularly adapted to achieve this result.

Further it is to be noted that, by the method of this invention it is possibe to produce permanent magnets of different resistivities depending on the viscosity of the resinous material used to form the matrix in which the magnetic particles are embedded. In general, if a high viscosity resin is used, the resultant magnet will have high resistivity because the magnetic particles will be less densely distributed throughout the matrix, while, if a low viscosity resin is used, the density of the particles will be greater. In any event, the method makes possible the achievement of very uniform distribution of the magnetic particles throughout the magnet structure. This is of very considerable importance where the magnets are to be used in magnetic bearings in which the uniformity of distribution of the magnetic particles as well as the resistivity are significant factors in determining the amount of drag produced in the bearing by reason of the production of eddy currents in the magnetic structures. Where two permanent magnets are juxtaposed to one another in such a bearing, no eddy currents will be produced regardless of the resistivity of the magnets if both are substantially uniform in their structure. However, if the magnets are of low resistivity and one of them is nonuniform in its structure, eddy currents will be generated in the other magnet which may tend to create large drag forces.

While in many applications the resinous matrix in which the magnetized particles are bound will be sufficient by itself to provide adequate physical strength in the unitary magnet structure, improvement in physical strength, which may be desirable in certain applications, may be achieved by introducing into the resinous matrix fibers of suitable materials such as glass, boron, graphite, fused silica or certain aromatic polyamides. Glass fibers suitable for this purpose may be of E or S type, and materials such as PRD-49 sold by DuPont under the name KEVLER are particularly suitable. These fibers may be introduced into the resinous material in the form of chopped roving either prior to or after the introduction of the resinous material into the container 1 of the apparatus hereinbefore described for practicing the method. In addition, the physical strength of the magnetic structure may be improved by inserting fiberglass cloth or mat into the container as a lining thereto prior to the introduction of the resinous material. The provision of such additional reinforcing means is particularly desirable for making magnets of relatively large dimensions by the method of the invention.

Further, in accordance with the invention, there may be incorporated into the permanent magnet structure formed thereby a coil of suitably insulated wire having leads extending externally of the magnet structure which may then be used to provide a permanent magnet whose magnetization is susceptible of being modulated or varied in response to an electric current of controlled magnitude supplied to the coil through its externally extending leads. Such a coil may be positioned in the container 1 of the apparatus hereinbefore described prior to the introduction of the resinous material and magnetized particles.

While the method of the invention and the magnet structure produced thereby have been described with reference to a preferred mode of practicing the method and a preferred magnet structure and certain modifications thereto, it will be understood that both the method and the structure produced thereby are subject to various modifications such as will occur to those skilled in the art upon reading the foregoing specification without departing from the scope of the invention as defined by the appended claims. For example, while the process has been described with reference to the production of a magnet of cylindrical form, it will be apparent that it also may be used to produce magnets of linear and other desired forms.

I claim:

1. The method of making a permanent magnet which comprises:

a. introducing a quantity of hardenable resinous material into a hollow mold, b. spinning said mold about an axis thereof to force said material against an internal surface of said mold, c. introducing premagnetized particles of powdered permanent magnet material into said resinous material while said mold is being spun, the rate of spinning of said mold being sufficient to cause said particles to be uniformly distributed around the circumference of said resinous material and throughout its length and to become densely concentrated in a region of said body of resinous material in the vicinity of its peripheral surface while leaving a lower concentration of said particles in the region of the inner surface of said body, d. exposing said particles to a magnetic field while they are being introduced into and distributed throughout said resinous material to align said particles magnetically, e. and hardening said resinous material while said mold is spun to form a body thereof in which said particles are magnetically aligned to form an effective permanent magnet structure.

2. The method of claim 1 in which said particles of permanent magnet material are of sizes in the range from 2 to 10 microns and in which the rate of spinning said mold is such as to produce forces on said particles which are in the range from 375 to 3000 G.

3. The method of claim 1 in which said particles have been premagnetized by exposing them to a magnetic field of the order of 100,000 Gauss or greater, and in which said particles are subjected to a magnetic field of the order of 1000 Gauss or greater while they are being introduced into and distributed throughout said resinous material.

4. The method of claim 1 in which said particles of magnetic material comprise an alloy of a rare earth metal with cobalt.

5. The method of claim 1 in which said particles of magnetic material comprise samarium cobalt.

6. The method of claim 1 in which said resinous material comprises a thermosetting plastic and in which hardening thereof is effected by the application of heat.

7. The method of claim 1 in which said resinous material comprises an epoxy resin including a catalyst for hardening it.

8. The method of claim 1 in which said resinous material comprises a cyanoacrylate.

9. The method of claim 1 in which said particles of permanent material are introduced into said resinous material by entraining them to a current of air directed into said mold.

* * * * *

PO-1050
(5/69)

UNITED STATES PATENT OFFICE
CERTIFICATE OF CORRECTION

Patent No. 3,985,588 Dated October 12, 1976

Inventor(s) Joseph Lyman

It is certified that error appears in the above-identified patent and that said Letters Patent are hereby corrected as shown below:

Column 6, line 57, after "per" insert -- cubic --. Claim 9, line 3, "to" should read -- in --.

Signed and Sealed this

Fourteenth Day of December 1976

[SEAL]

*Attest:*

RUTH C. MASON
*Attesting Officer*

C. MARSHALL DANN
*Commissioner of Patents and Trademarks*